US009227232B2

(12) United States Patent
Bramsen

(10) Patent No.: US 9,227,232 B2
(45) Date of Patent: Jan. 5, 2016

(54) AUTOMATED TANK CLEANING MONITORING SYSTEM

(75) Inventor: Franklin Erik Bramsen, St. Charles, IL (US)

(73) Assignee: Spraying Systems Co., Wheaton, IL (US)

( * ) Notice: Subject to any disclaimer, the term of this patent is extended or adjusted under 35 U.S.C. 154(b) by 1257 days.

(21) Appl. No.: 12/356,819

(22) Filed: Jan. 21, 2009

(65) Prior Publication Data

US 2009/0173362 A1 Jul. 9, 2009

Related U.S. Application Data

(63) Continuation-in-part of application No. 11/612,979, filed on Dec. 19, 2006.

(51) Int. Cl.
*B08B 9/093* (2006.01)

(52) U.S. Cl.
CPC ..... *B08B 9/0936* (2013.01)

(58) Field of Classification Search
CPC ..... B08B 9/0936; B08B 9/08; B08B 9/093
USPC ..... 134/18, 167 R, 168 R
See application file for complete search history.

(56) References Cited

U.S. PATENT DOCUMENTS

| | | | | |
|---|---|---|---|---|
| 4,343,656 | A * | 8/1982 | Tuchenhagen | 134/18 |
| 5,279,675 | A * | 1/1994 | Verbeek | 134/22.1 |
| 5,460,193 | A * | 10/1995 | Levallois et al. | 134/56 R |
| 5,660,194 | A | 8/1997 | Sanders | |
| 5,925,193 | A * | 7/1999 | Bude et al. | 134/18 |
| 5,954,271 | A | 9/1999 | Le | |
| 6,039,056 | A * | 3/2000 | Verbeek | 134/22.18 |
| 7,093,485 | B2 | 8/2006 | Newman et al. | |
| 2005/0236021 | A1 | 10/2005 | Suzuki | |

FOREIGN PATENT DOCUMENTS

EP 0624406 A1 11/1994

OTHER PUBLICATIONS

Foreign Search Report for International Application No. PCT/US07/85742 filed Nov. 28, 2007.

Supplementary European Search Report, dated Aug. 4, 2011, in corresponding European Patent Application No. 07868903.1.

* cited by examiner

*Primary Examiner* — Douglas Lee
(74) *Attorney, Agent, or Firm* — Leydig, Voit & Mayer, Ltd.

(57) ABSTRACT

A tank cleaning verification process works in conjunction with a specialized spray head to evaluate cleaning efficacy and to ensure proper cleaning. The system includes an encoder, and one or more pressure sensors to verify proper operation as the tank cleaning system automatically accounts for one or more characteristics of the vessel being cleaned and modifies the cleaning operation accordingly.

10 Claims, 8 Drawing Sheets

AUTOMATED TANK CLEANING MONITORING SYSTEM

CROSS-REFERENCE TO RELATED APPLICATIONS

This patent application is a continuation-in-part of copending U.S. patent application Ser. No. 11/612,979, filed Dec. 19, 2006, which is herein incorporated by reference in its entirety for all that it teaches without exclusion of any part thereof, as if fully set forth herein.

FIELD OF THE INVENTION

The present invention relates generally to tank cleaning verification and control, and more particularly to internal tank cleaning systems and apparatus which are particularly adapted for cleaning validation.

BACKGROUND OF THE INVENTION

Fluid containment tanks are utilized in a multitude of industrial processes such as food and chemical manufacturing and processing, pharmaceutical manufacturing, wine preparation, material fermentation, and so on. It is often critical to ensure that the interior of the tank is free of unwanted debris and contaminants. For example, a tank that is typically filled to a certain level may exhibit a "tub ring" about its interior circumference at the level to which the tank is most often filled. Moreover, paddles, mixers, and other equipment within a tank may trap debris via a coating or other deposit. Tank inlets and outlets are also known to trap sediment or debris that may later reenter the tank contents during use.

Unwanted contaminants in the tank may negatively impact the quality of the finished product being processed or manufactured. Moreover, the failure to adequately clean the tank interior can violate regulations relevant to certain industries such as pharmaceutical processing. Thus, it is common to clean the interior of such tanks at certain intervals, e.g., after each process batch, to ensure product quality and adherence to any relevant regulations.

Tank cleaning machines and equipment are available that clean debris and residue from within tanks and other vessels through the use of what is commonly known as impingement cleaning. One common type of cleaning system employs a tool inserted into the tank. The inserted tool may be placed permanently or temporarily within the tank and is typically sealed to the tank via a flange. A rod-like extension of the tool within the tank interior supports a rotary spray head affixed at its innermost end. The rod-like extension comprises a fixed tubular housing supporting an internal rotary shaft for rotating the spray head about the axis of the shaft. In addition, the spray head is generally geared to the fixed housing such that as the spray head rotates about the axis of the shaft, it also turns upon an axis perpendicular to the shaft.

The relationship between the shaft rotation and the rotation of the spray head perpendicular to the shaft depends upon the ratio of the gearing connecting the spray head to the fixed housing. Typically, the ratio is selected such that a combination of a particular orientation and position of the spray head repeats only after multiple revolutions of the shaft. This technique staggers subsequent traces of the spray against the tank interior on each shaft revolution to ensure that substantially every portion of the tank interior is exposed to the cleaning spray at some point during the cleaning process.

While this system is simple and mechanically robust, it creates certain inefficiencies and can also be less than fully effective depending upon the mode of operation. With respect to effectiveness, it will be appreciated that known systems such as those described above are not adapted to provide a constant volume of cleaning solution against all portions of a uniformly soiled surface. Moreover, systems such as those described above are not adapted to provide a volume of cleaning solution against particular portions of the interior in relation to the known heavy soiling of those portions.

For example, in the case of a deposit ring at a vessel fill line, although the fill line portion of the interior is known to experience increased soiling, existing systems do not allow the operator to customize the clean operation to more heavily clean such portions. Thus, in typical uses, the systems described above may lead to excess cleaning of some tank portions and inadequate cleaning of other portions. Although the cleaning duration may be prolonged to ensure adequate cleaning of the most heavily soiled interior portions, this leads to additional waste of time, cleaning fluid, and energy with respect to the lightly soiled surfaces.

BRIEF SUMMARY OF THE INVENTION

The invention provides a tank cleaning verification process that works in conjunction with a specialized spray head to evaluate cleaning efficacy and to ensure proper cleaning. The system includes an encoder, and one or more pressure sensors to verify proper operation as the tank cleaning system automatically accounts for one or more characteristics of the vessel being cleaned and modifies the cleaning operation accordingly.

Figure 1:
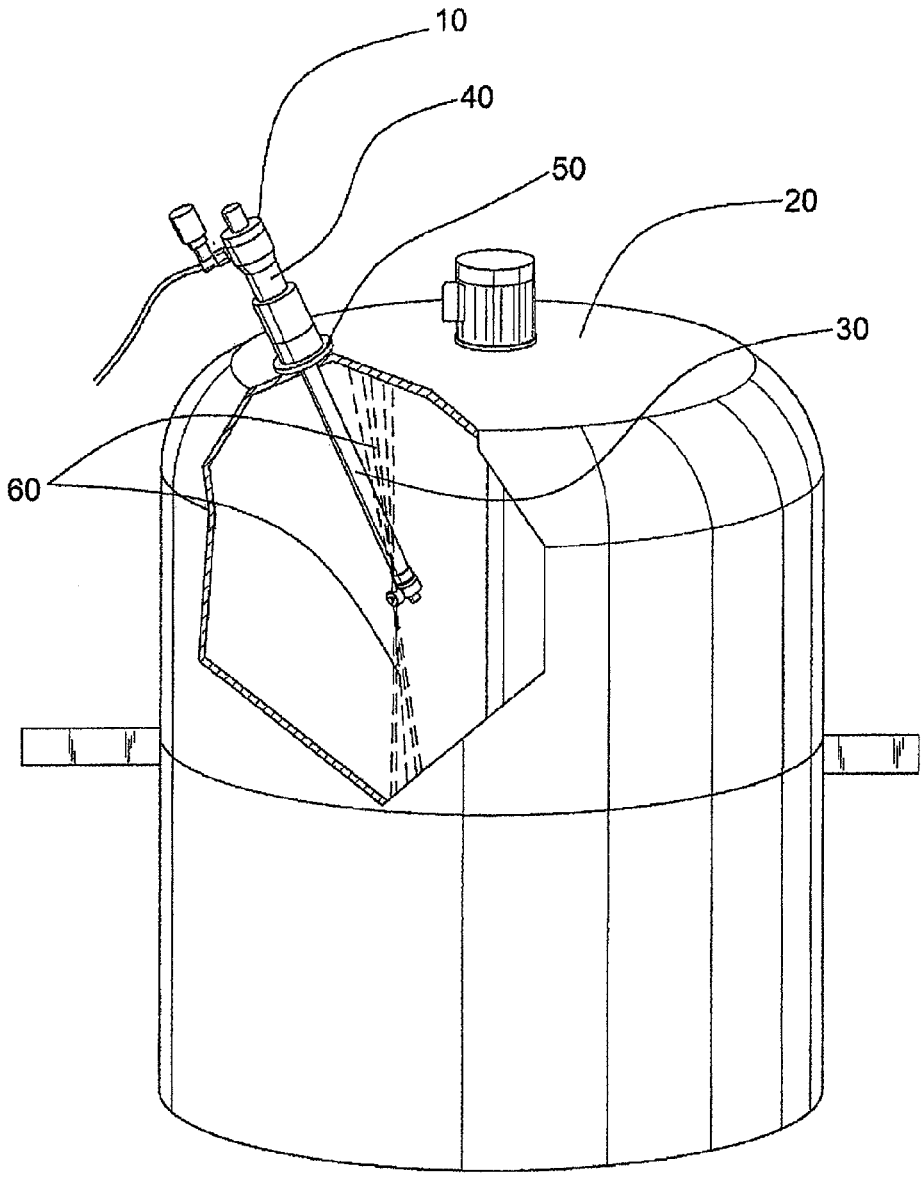
FIG. 1 is a cut away perspective depiction of an illustrative containment tank comprising a tank cleaning system usable in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative tank cleaning apparatus 10 which has particular utility in selectively cleaning the interior surface of a tank 20. The tank cleaning apparatus 10, which will be discussed in greater detail with reference to FIG. 2, comprises a tubular portion 30 extending into the tank 20 and an actuating portion 40 situated outside of the tank 20.

While the inner 30 and outer 40 portions of the cleaning apparatus 10 are in mechanical and fluid communication as will be discussed in greater detail hereinafter, the interior volume of the tank 20 is sealed from external environment via an annular seal, e.g. a deformable or compressible flange at the location 50 in the tank 20 at which the inner tubular portion 30 of the cleaning apparatus 10 enters the tank 20.

During a cleaning process, the tank cleaning apparatus 10 projects a cleaning fluid in one or more streams numbered as 60 against the walls of the tank 20. While projecting the streams 60 against the walls of the tank 20, the tank cleaning system 10 progressively varies the location of impingement of the streams on the tank 20 so as to eventually cleanse substantially the entire interior surface of the tank 20, including the interior portions of flanges, paddles, mixers, and other elements and equipment in fluid communication with the interior of the tank 20.

The manner in which the points of impingement on the interior surface of the tank 20 are controlled will be discussed in greater detail below by reference to FIG. 4. It will be appreciated that the impingement of cleaning fluid may be direct with respect to some portions of the interior of the tank 20, while being indirect with respect to other portions. For example, interior surface portions obscured from the stream(s) 60 by equipment or other tank surfaces may be indirectly rather than directly sprayed.

As noted above, the illustrative tank cleaning system 10 comprises a tubular portion 30 extending into the tank 20 and an actuating portion 40 situated outside of the tank 20. A flange 100 separates the inner 30 and outer 40 portions of the cleaning device 10 and serves to seal the device 10 to a tank wall.

The actuating portion 40 situated outside of the tank 20 further comprises an inlet 110 for receiving pressurized cleaning fluid. The source of cleaning fluid supplied to the inlet 110 is typically a pressurized reservoir, and as such it is sometimes difficult to precisely control the rate of flow of the pressurized fluid through the device 10. The source of fluid can instead be a pump connected to the inlet 110 in accordance with the invention, although such is not required in every embodiment. The received fluid is conveyed to the interior portion 30 of the device 10 and ejected into the attached tank (FIG. 1) for cleaning as will be discussed in greater detail below. The actuating portion 40 situated outside of the tank 20 further comprises an exposed shaft end 120 for mechanically receiving a source of rotational energy (not shown in FIG. 2). The air motor or electric motor and speed reduction gear assembly 120 is mechanically linked to a shaft which passes through the flange 100 and into the tank interior. A rotational position sensor is mounted to the shaft in such a way that it will detect the rotational position of the shaft. The point of exit of the shaft from the flange is sealed from both the tank interior volume and the inlet 110, so as to convey rotary motion into the tank interior without allowing leakage of the tank contents or the cleaning fluid from the device 110.

The interior portion 30 of the device 10 further comprises a fixed tubular housing 140 and a rotary end portion 130. The rotary end portion 130 further comprises a spray head 150 having thereon one or more spray nozzles 160.

The fixed tubular housing contains a shaft (not shown) that is in mechanical registration with the air motor or electric motor 120 via the sensor for transfer or rotary motion therefrom. The outer visible housing 140 has an interior passage containing the shaft that is maintained in fluid communication with inlet 110. It will be appreciated that one or more rotary seals (not shown) may be used to allow for the conveyance of pressurized fluid into the rotating shaft within the housing 140.

As indicated above, the spray head 150 is supplied with pressurized fluid which is ejected from the spray nozzle(s) 160. As the pressurized fluid is ejected from the nozzle(s) 160, the spray head 150 is rotated about a vertical axis A (i.e., the axis of the interior shaft) via the exposed shaft connected to air motor or electric motor 120. In turn, as the spray head 150 rotates about the vertical axis A, the spray head 150 also rotates about a perpendicular axis B due to the geared connection between the spray head 150 and the housing 140.

Nevertheless, an inability previously to monitor and control the position and orientation of the spray head has resulted in varying degrees of inefficiency and/or ineffectiveness. As discussed above, it has heretofore been necessary to extend the duration or intensity of the cleaning cycle to ensure that the most heavily soiled areas are adequately cleaned. However, this often results in the over-cleaning of lightly soiled areas, with a corresponding waste of process time and cleaning fluid.

In accordance with the invention, the position and orientation of the spray head 150 can be selectively or automatically operated and monitored for effective and efficient cleaning as well as process validation. In the illustrated embodiment, the position and orientation of the spray head 150 is monitored via a rotational position sensor and is controlled in accordance with a number of parameters related to the tank configuration and internal environment to effect optimal cleaning.

Figure 3:
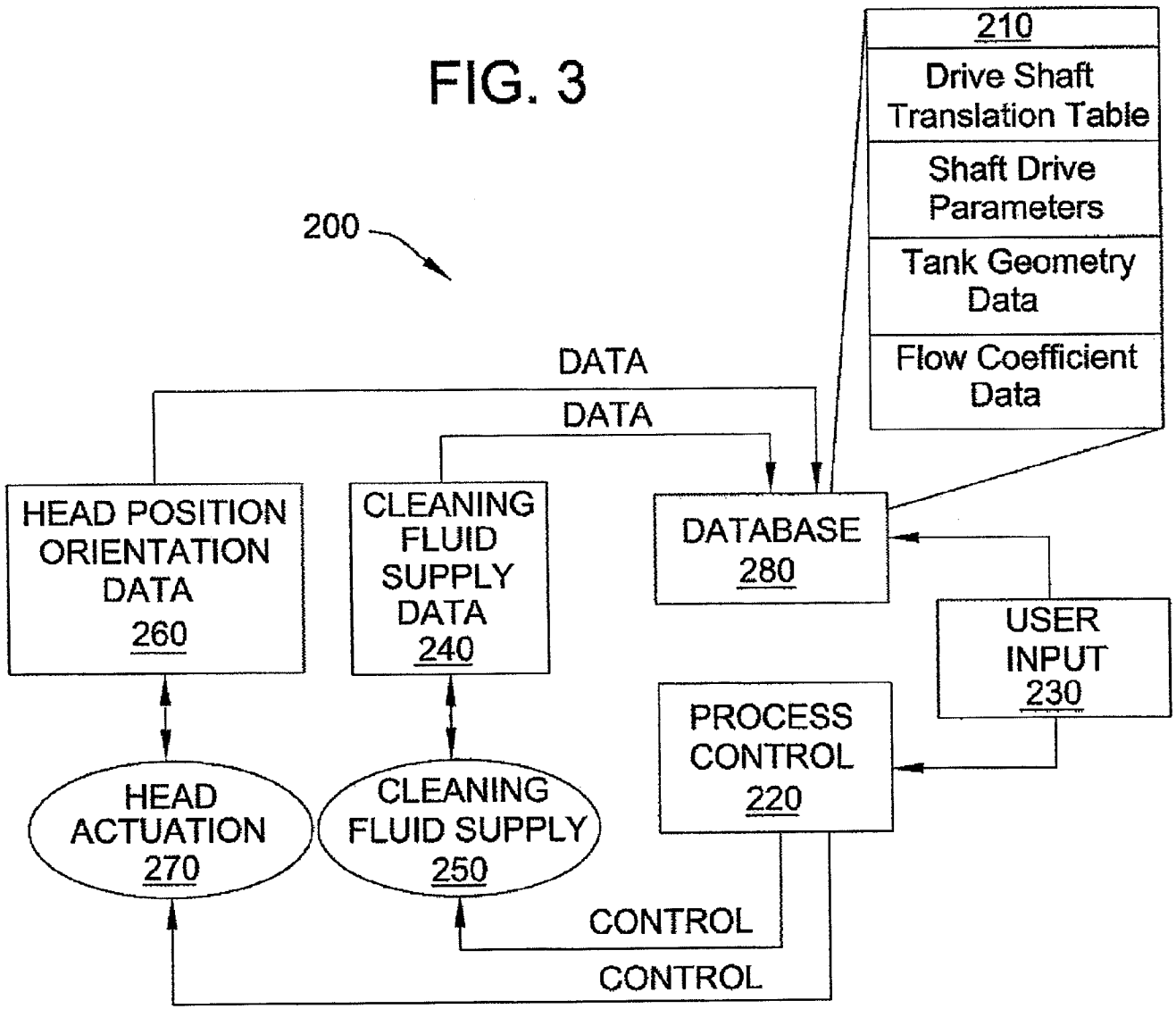
FIG. 3 is a schematic diagram illustrating exemplary interconnections within a tank cleaning system according to the invention.

An illustrative system according to the invention can be appreciated in overview by reference to the schematic diagram of FIG. 3. The system 200 comprises data sources and data sinks interconnected to control a tank cleaning process. The process is controlled by a control module 220. The control module 220 is a computer-implemented module stored in computer-executable instructions on a computer-readable medium. The control module may be implemented in executable code, interpreted code, script, or other suitable code type.

The control module 220 is activated via a user interface 230. In accordance with one aspect of the invention, the cleaning process may also be controlled at least in part via the user interface 230 as well. The user interface may comprise a keyboard, touch screen, mouse, stylus, voice command module, or other input mechanism, and may also comprise a screen or other output device for communication with a user. The user interface may also include alternative input means such as a CD-ROM drive, DVD drive, thumb drive interface, etc., in order to accept data from the user and/or to convey data to the user.

In carrying out the invention, the control module 220 receives process data from a database 280 and controls one or more parameters of the cleaning process accordingly. To this end, the control module is communicably linked to a spray head actuation element 270. The spray head actuation element 270 controls the position (and thus also the orientation) of the spray head.

In one aspect of the invention, the spray head actuation element 270 is a drive unit, e.g., an air motor, which drives the shaft of a cleaning device spray head as described above. In another aspect of the invention, the spray head actuation element 270 is a brake unit, e.g., a disk, drum, or electrodynamic drag unit, which controls the rotation of the shaft via a braking action.

In further keeping with the invention, the control module 220 is also optionally communicably linked to a cleaning fluid supply source 250 to control a parameter of the fluid supplied to the spray head. Typically the control module 220 will control the pressure at which fluid is delivered to the head, controlling the pressure and/or flow rate at which the cleaning fluid is expelled from the nozzles of the spray head.

The control module 220 controls the head actuation element 270 and optionally the fluid supply 250 in keeping with real-time process data as well as pre-stored process environment data as illustrated in data field 210 of database 280. To this end, the database 260 is communicably linked to a source 260 of information regarding the spray head position and orientation. This data source comprises a self-contained rotational position sensor such as an optical encoder (not shown) in accordance with one aspect of the invention, although the sensor may be otherwise. For example, a photodetector may be used in conjunction with a gear tooth, hole, or other transmissive or reflective aperture or element to sense rotation.

Preferably, the rotational position sensor is located on the drive shaft of the device 10. Locating the rotational position sensor in this manner as opposed to locating it on the motor shaft or spray head itself provides several advantages. For example, the drive shaft operates at a greatly reduced rotational velocity to the drive motor, the rotary position sensor is located externally and need not be as carefully sealed as it would otherwise need to be. In addition, the need to carry electrical signals away from the head via a rotary seal is avoided.

Because the rotational position sensor tracks two parameters (position and orientation) linked by starting position/orientation as well as system gearing, a translation table or algorithm is used to translate the rotary position sensor output into position and orientation data. The table may be implemented as part of the data source 260, or may be stored in the database 280. In the former case, the position orientation is provided to the database 260 ready for use by the process control module 220. In the latter case, the data is translated after receipt by the database 260, either as needed or prior to storage.

In further keeping with an optional aspect of the invention, as noted above, the process control module 220 may control the cleaning fluid supply 250. To this end, the database 280 is communicably linked to a data source 240 supplying data related to one or more parameters of the cleaning fluid supply. Exemplary parameters include fluid pressure, remaining fluid level, fluid flow rate, etc. This feedback allows the process control module 220 to more accurately control the fluid supply.

Regardless of whether the control module 220 controls the fluid supply, data relating to the fluid supply is useful to ensure that the cleaning process is carried out properly. For example, an unanticipated spike in supply pressure and/or drop in fluid flow rate may indicate a clogged nozzle, and consequential failure of the cleaning process. In an aspect of the invention, it is important for the system to signal a failure so that the cleaning process is not erroneously assumed to have been completed according to a validated cleaning process.

As noted above, in an aspect of the invention, the control module 220 controls the head actuation element 270 and optionally the fluid supply 250 in keeping with both real-time process data as described above, as well as pre-stored process environment data. The pre-stored data can include any data that impacts the cleaning process. Exemplary pre-stored data includes the drive shaft translation table, shaft drive parameters (e.g., current/voltage/air pressure v. RPM/torque), tank geometry data (e.g., size, shape, internal features such as paddles, fill line rings, hatches, flanges, ports, etc.), and fluid flow coefficient data (e.g., cleaning fluid pressure v. flow rate, nozzle characteristics, etc.).

Figure 2:
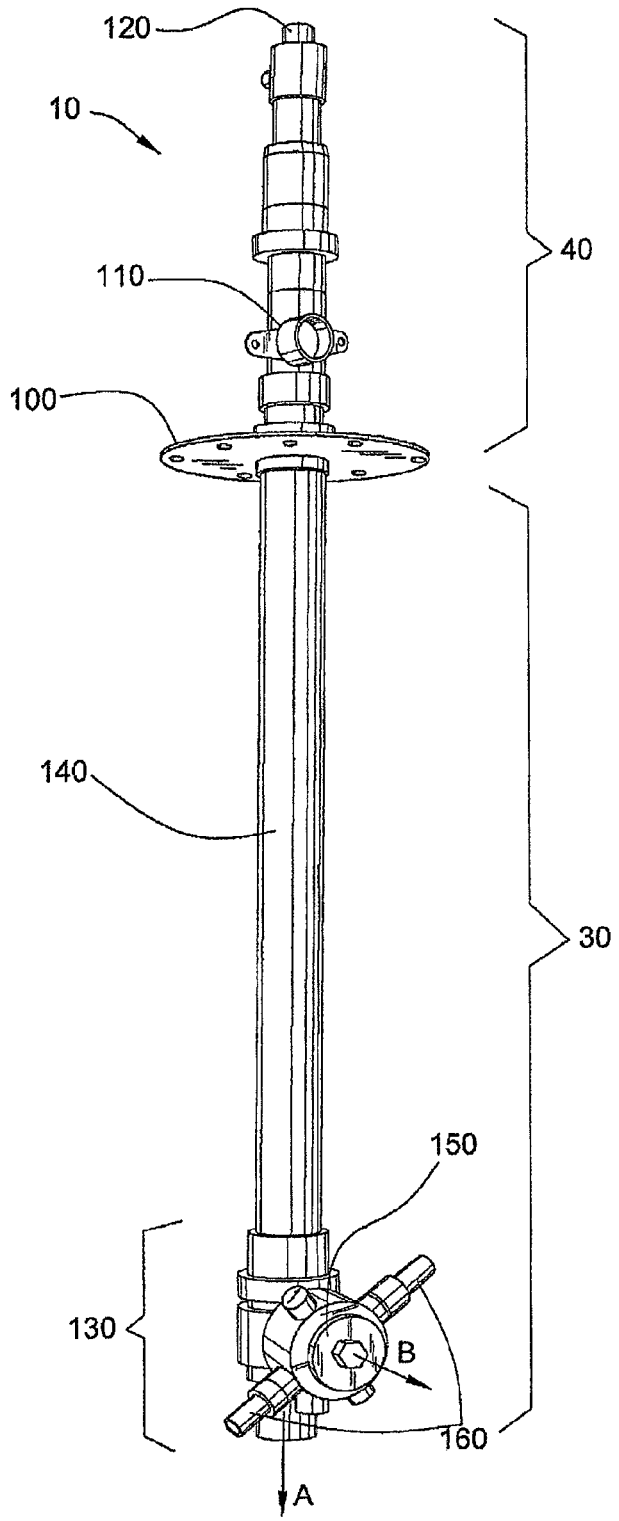
FIG. 2 is an enlarged perspective drawing of the tank cleaning portion of the system illustrated in FIG. 1.

Having discussed the schematic overview of the tank cleaning system according to an aspect of an invention, the system will be discussed at a physical level with reference to the cut away perspective view of FIG. 4. The tank cleaning system 300 comprises a tank cleaning device 310 as shown in FIG. 2 (element 10), including a tubular portion 320 (FIG. 2, element 140) extending into the tank and an actuating portion 460 (FIG. 2, element 40), a flange 360 (FIG. 2, element 100), an inlet 380 (FIG. 2, element 110) for receiving pressurized cleaning fluid, an exposed shaft end 390 (FIG. 2, element 120), and a rotary end portion (FIG. 2, element 130) comprising a spray head 410 (FIG. 2, element 150) having thereon one or more spray nozzles 420 (FIG. 2, element 160).

Figure 4:
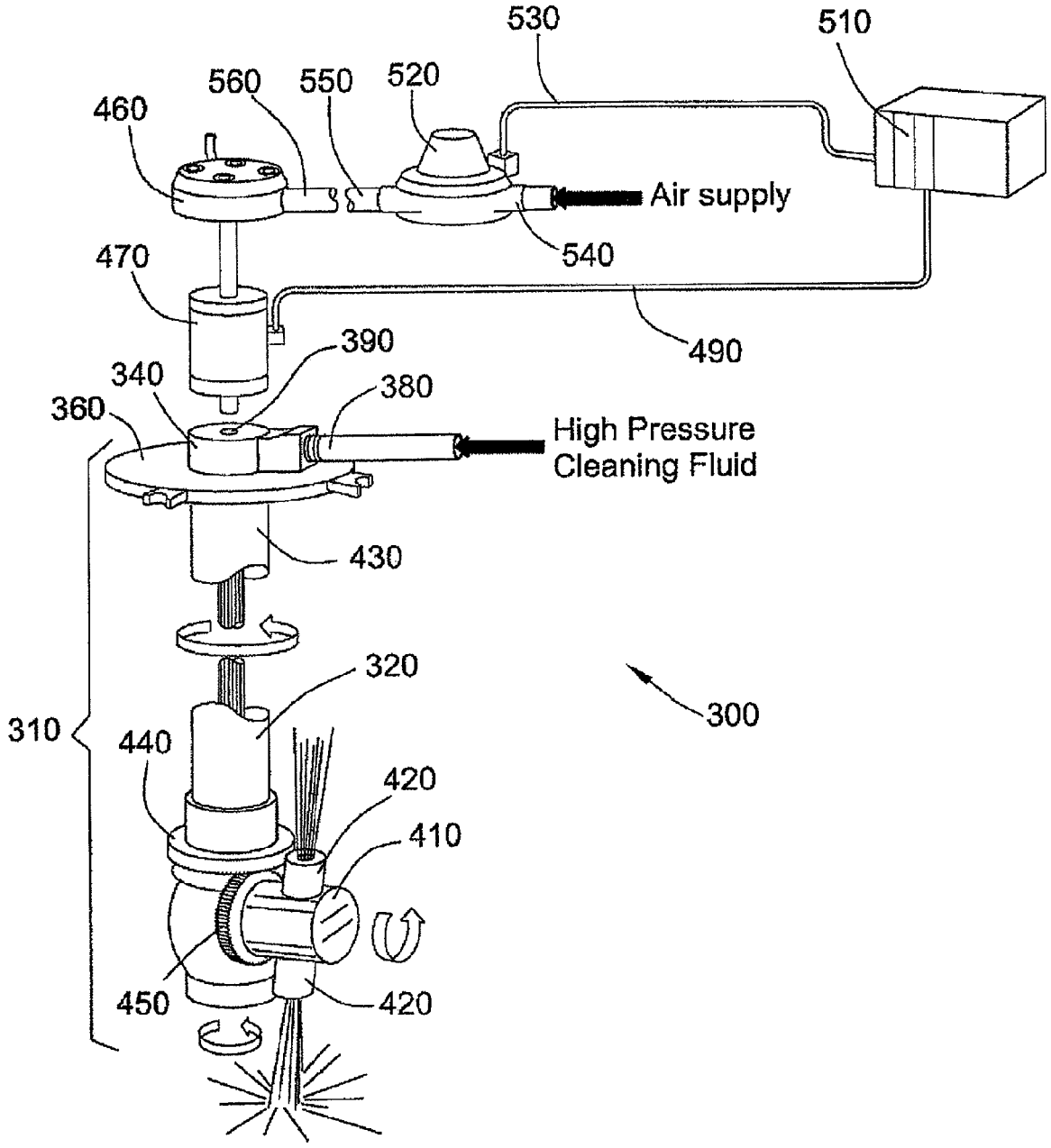
FIG. 4 is a longitudinal, vertical section of the tank cleaning device as illustrated in FIG. 2, further comprising a control portion.

In addition, the shaft 430 within the fixed tubular housing 320 can be seen in the cut away view of FIG. 4. This shaft 430 carries rotary motion from the exposed end shaft 390 to the rotary head including the spray head 410. The geared ring 440 at the end of the tubular housing 320 meshes with the gear 450 affixed to the spray head 410 to turn the head 410 as discussed above. Those of skill in the art will be familiar with the principles of operation of the device 310. A device configured in the described manner is the model AA190 Tank Washer manufactured by SPRAYING SYSTEMS COMPANY of Wheaton, Ill.

To control the operation of the tank cleaning device 310, a motor and gear reduction assembly 460 is connected in rotary registration with the shaft 430 via the exposed end 390. In the illustrated example, the assembly 460 is a geared air driven motor, however it will be appreciated that other types of motors and drive systems may be used.

In the illustrated example, the assembly 460 is affixed to the shaft 430 via a rotational sensor 470. The rotational sensor may be of any suitable type, but is preferably a high resolution rotational sensor (e.g., 17 bits) that tracks both absolute shaft position and number of revolutions executed. The tracking of the absolute shaft position and number of revolutions executed may be performed by the rotary position sensor 470 alone, the controller circuit 510 alone, or a combination of the two elements.

The rotary position sensor sends a data output linked via link 490 to a control circuit 510. The control circuit 510 may be a programmable logic circuit (PLC) that contains control logic (i.e., computer-executable instructions) for the cleaning operation. Alternatively, the control circuit may comprise a computer, workstation, or other computing device for executing the appropriate control logic (e.g., implementing control module 220).

In the illustrated example, the control circuit 510 controls the motor of the assembly 460, and hence the shaft 430, via control of the air pressure supplied to assembly 460. Control of the air pressure supplied to assembly 460 is executed via an electronically controlled pressure regulator (I/P) 520, which receives pressurized air at inlet 540 and provides a controlled output at outlet 550. Outlet 550 is in turn linked to the assembly 460 via a conduit 560.

The pressure regulator 520 receives an electrical control signal from the control circuit 510 via electrical link 530. The control signal comprises any suitable signal type and/or protocol, but in a preferred embodiment of the invention the control signal is a 4-20 mA open loop control signal. In turn, the pressure regulator regulates the pressure of air supplied at outlet 550. Thus, the control signal received over link 530 is used to control the speed of the assembly 460 and the shaft 430. Although not shown in FIG. 4, the control circuit 510 also optionally controls one or parameters of the cleaning fluid received at inlet 380 as discussed above.

The cleaning process according to various aspects of the invention can be automatically executed on the occurrence of a trigger event or period. For example, a cleaning cycle may be triggered by the completion of a processing step using the tank in question. Alternatively, the cleaning process may occur automatically on a predetermined schedule such as every 24 hours. The cleaning process may also be user activated.

Figure 5:
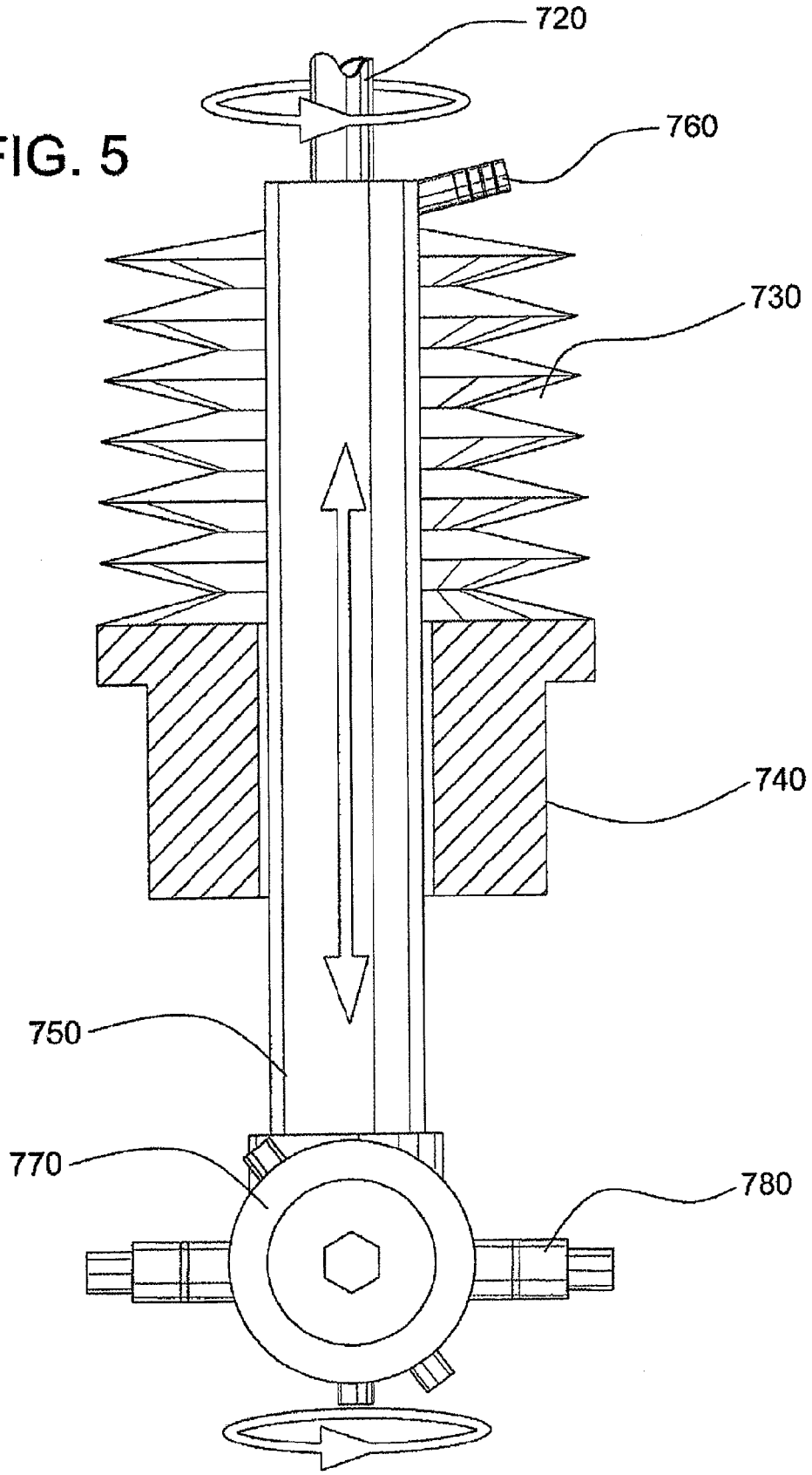
FIG. 5 is a longitudinal, vertical section of a tank cleaning device providing a linear degree of freedom along the axis of shaft rotation.

The tank cleaning device 700 as shown in FIG. 5 is similar to that illustrated in FIG. 2 (element 10) and FIG. 4 (element 310), but is provided with an additional degree of linear movement along the axis of the rotary shaft 720. In particular, in the illustrated example, the tubular housing 750 enclosing the rotary shaft 720 is slidably linked through the flange 740 which is sealed to the tank wall (not shown). In addition to the rotary seals discussed above that allow rotation of the shaft 720 and the spray head 770 in fluid communication with the fluid inlet 760, a bellows 730 or other linearly slidable seal mechanism is used to allow the housing 750 to slide relative to the flange 740 in a sealed manner.

The linear position of the housing 750 relative to the flange 740 is controlled by the control module as discussed above to alter the point of impact of the fluid jets ejected from the nozzles 780. The actuator (not shown) used to change the linear position of the housing may be a hydraulic mechanism, a rack and pinion mechanism, or other suitable mechanism.

Although the accompanying discussion has referred to generally to the cleaning of closed tanks and enclosures, it will be appreciated that the invention is not so limited. For example, the invention may also be used for the cleaning of vats and other open-topped containers. To avoid excess spray out of the open portion of the container, the fluid flow may be not just slowed, but completely interrupted as desired for certain orientations. Particularly, though not exclusively, for a single nozzle or outlet spray head, stopping the fluid flow when the spray would exit the vessel mouth will conserve cleaning fluid and avoid unnecessary mess.

Figure 6:
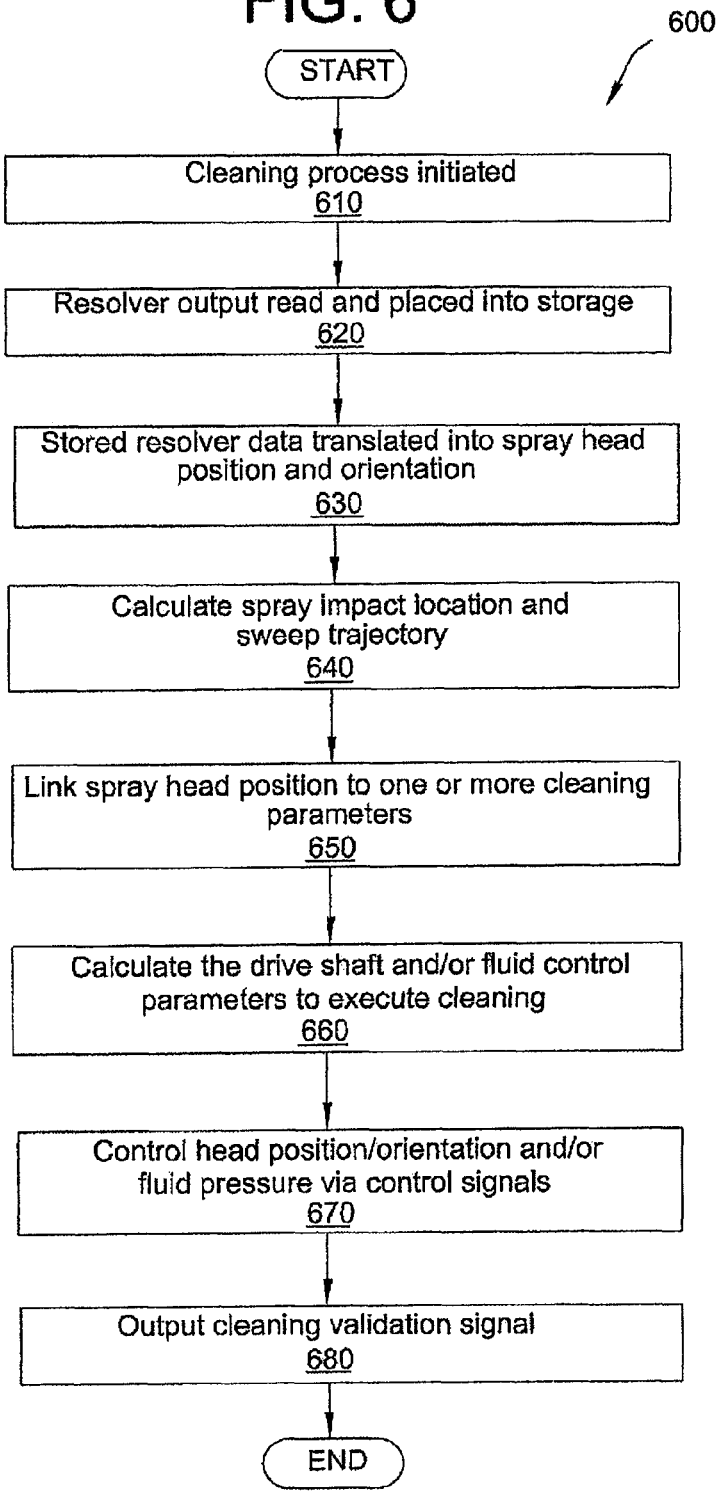
FIG. 6 is a procedure flow diagram illustrating processes and data flow activities executed during an illustrative tank cleaning procedure in keeping with the invention.

The flow chart of FIG. 6 illustrates steps taken in keeping with the invention to execute a tank cleaning procedure using a tank cleaning device and system as described above. At stage 610 of process 600, the cleaning process is initiated, e.g., by a press of a button by a user, or pursuant to a schedule or other trigger. Next, the control module determines the starting position (e.g., axial position relative to shaft 430) and orientation (e.g., on an axis perpendicular to shaft 430) of the spray head within the tank. In particular, at stage 620, the output of a rotational position sensor as described above is read and placed into temporary or permanent storage, e.g., within database 280. At stage 630, the stored rotational position sensor data is translated into a spray head position and orientation. The translation may be executed via a translation or mapping table or via an algorithmic transformation as described above.

Based upon the determined spray head position and orientation, the tank cleaning system calculates the spray impact location(s) and sweep trajectory or trajectories of the spray jet(s) at stage 640. In addition to the spray head position and orientation data, this stage also utilizes other appropriate data such as the vessel surface geometry, cleaning fluid supply data (e.g., fluid supply pressure), and fluid flow coefficient data, as may be obtained from data field 210 of database 280.

Once the spray impact locations and sweep trajectories have been calculated, the relationship between spray head position and impingement point is known. At stage 650, this data is used, in conjunction with other data, to link the spray head position to one or more cleaning parameters. For example, the cleaning fluid pressure and stream dwell time both impact the degree of cleaning accomplished in a given location of the tank interior. Thus, adjusting either or both of these independent parameters will impact the cleaning action.

The additional data used at stage 650 to calculate the link between the spray head position and the one or more cleaning parameters can include data relating to both the tank geometry and specific cleaning needs at points within the tank. For example, points that lie further from the spray head nozzles can be subjected to a greater time averaged impact force and/or duration of spray. Points that need to be indirectly sprayed may similarly require a greater flow rate and/or duration of spray. Yet another type of specific cleaning issue is the existence of fill line rings and other more highly soiled areas, and such location may similarly be subjected to a greater time averaged impact force and/or duration of spray.

At stage 660, the control module calculates the drive shaft control parameters and/or fluid control parameters needed to execute the cleaning within the cleaning parameters determined in stage 650. For example, if the cleaning parameters indicate that additional cleaning is required at a particular head position, the control module will generate signals to slow the head rotation at that position and/or to increase fluid pressure at that position.

The control signals are calculated based on the response characteristics of the controlled element. Thus, for example, the motor control signals are calculated based on the motor's RPM response to the input control (voltage, PSI air, etc.). Similarly, by way of example, the fluid pressure control signals are calculated based on the response of the control element (e.g., the electronically controlled pressure regulator) to the input signal type (e.g., voltage or current (4-20 mA)).

Once the control parameters are calculated, the control module controls the head position and orientation, which are interrelated by the gear ratio at the head as illustrated in FIG. 4, and/or the cleaning fluid pressure by outputting the appropriate control signals at stage 670. In this way, the automated cleaning of the tank in an efficient and effective manner is performed. For example, the control module may increase the fluid pressure and/or slow or stop the spray head when fluid is directed at known soiled locations.

Once the cleaning cycle is completed, the control module outputs a cleaning validation signal at stage 680 in one aspect of the invention. For example, the control module may cause an audible alert signal to be emitted, such as via a speaker or piezo element. In addition or alternatively, a textual and/or graphical cleaning validation message may be displayed to the user via the user interface. In this manner, the user can ensure compliance with applicable regulations and/or policies regarding vessel cleaning.

Figure 7:
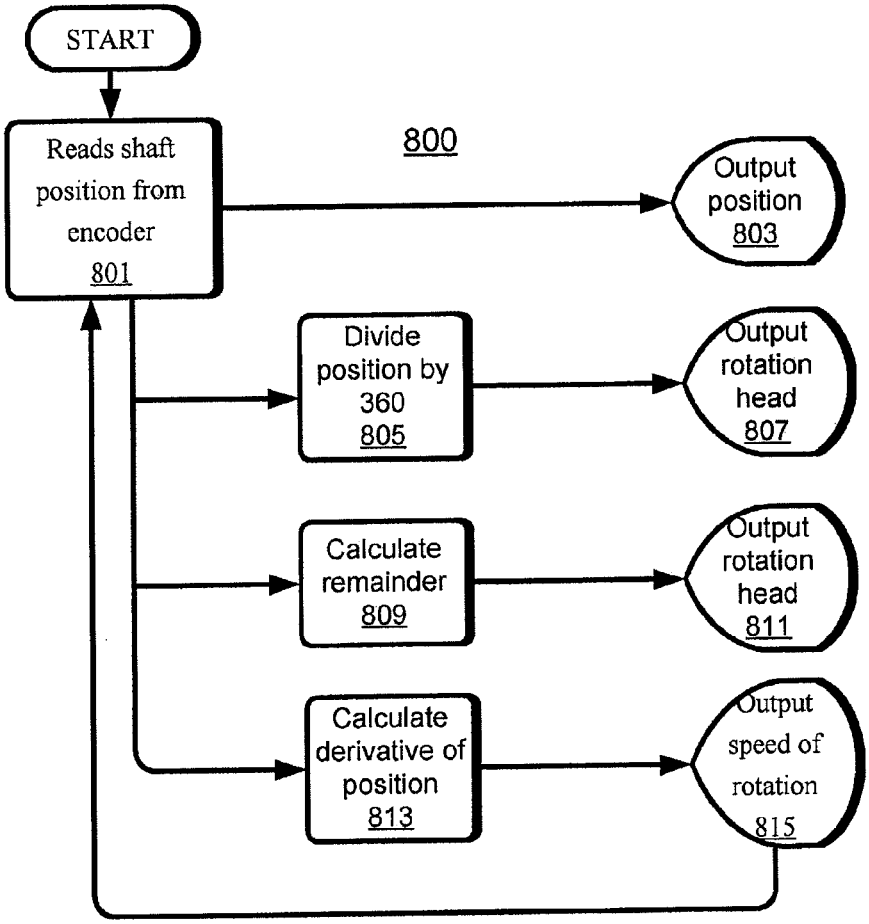
FIG. 7 is a flowchart showing a process of extracting head position, rotation, angle and speed data in an embodiment of the invention.

In an embodiment of the invention, the controller for executing the positioning of the spray head 150 is located within the rotary position sensor 470, which in this embodiment of the invention may be a rotary encoder. FIG. 7 illustrates in flow chart format a process set 800 for tracking and processing rotation information. At stage 801, the process reads the shaft position from the encoder. It will be appreciated that stage 801 is executed periodically, such as every 10 ms. If too great a delay or long a loop time is allowed, the system may experience hysteresis and/or a decrease in accuracy. The position may be in accumulated degrees, e.g., 2100 degrees, and is output, e.g. to a display or to a further processing unit, at stage 803.

After reading the shaft position in stage 801, the process divides the position, in degrees, by 360 in stage 805 to obtain the present rotation of the head. The quotient may be rounded downward as well at this stage to avoid fractional rotations. The resulting value is output at stage 807, again to a display and/or a further processing function. Thus, using the example above, the value 2100/360=5.833≅5 would be calculated at stage 805 and output at stage 807, signifying that the head is in its $5^{th}$ rotation.

Moving to stage 809, the process calculates the remainder of the division by 360 to signify the angle of the head. The value is output at stage 811. Thus, continuing with the example above, the remainder value is 0.833. Converting this to angles we arrive at approximately 300 degrees or ⅚ of one rotation.

At stage 813, the process calculates a derivative of the position to arrive at the rate of change, or speed of rotation. This value is output at stage 815. From stage 815, the process 800 returns to stage 801 and iterates back through the aforementioned stages, updating the output values as appropriate.

The values output from process 800 are used to determine the rotation (0, 1, . . . n), angle (x°), and rotational speed (degrees per second) of the head. Because the head is being driven at specific speeds through specific angles and rotation, the data gathered in process 800 can be used to verify that the spray head is indeed traversing the tank as expected, thus verifying the tank cleaning process.

However, it will be appreciated that the expected cleaning action will not occur unless the fluid flow is also as expected. Thus, a fully or partially clogged head or a loss of pressure at the source will prevent proper cleaning and must be detected if the tank cleaning is to be verified. In an embodiment of the invention, the fluid pressure is used to gauge the health of the spray head. Thus, for example, if the fluid pressure rises, it is likely that the head is partially or completely blocked. Similarly, if the fluid pressure drops, it is likely that the source pressure has dropped. In either case, effective cleaning does not occur.

In an embodiment of the invention, portions of the cleaning process in which an abnormal pressure condition is observed are tracked for later reiteration. In another embodiment of the invention, the cleaning process is failed if an abnormal pressure condition is observed.

Figure 8:
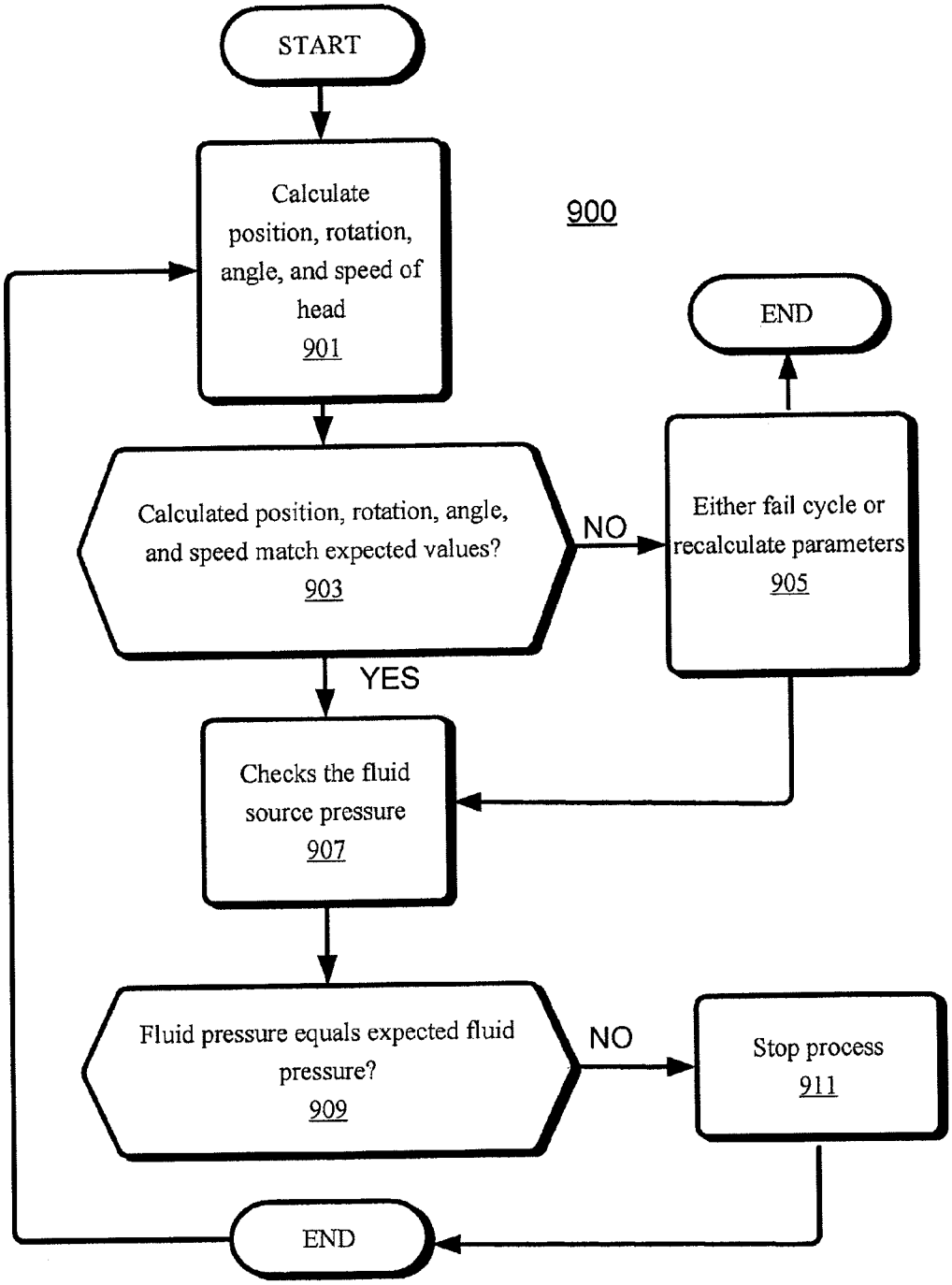
FIG. 8 is a flowchart illustrating a method of verifying proper cleaning operation in an embodiment of the invention.

FIG. 8 illustrates a process 900 for validating a tank cleaning cycle implemented via a spray head as discussed elsewhere herein. At stage 901, a process controller calculates the position, rotation, angle, and speed of the head as discussed above. At stage 903, the calculated position, rotation, angle, and speed are compared to expected values of such parameters based on control signals provided to the head. If the calculated values do not substantially match the expected values, then the process moves stage 905, whereat the controller either fails the cycle or recalculates the drive parameter to better match the expected values.

If the process fails the cycle, the process ends. Otherwise, the process continues to stage 907, and the processor checks the fluid source pressure. The fluid pressure is compared to the expected fluid pressure at stage 909. If the fluid source pressure is substantially less than or greater than that expected, e.g., if it varies by more than 10%, then the process either fails the verification and stops the cleaning process at stage 911, or it notes the position at which the error occurred and loops back to stage 901 to continue. It will be appreciated that other pressure limits may be used additionally or alternatively. For example, the actual limit may be higher or lower than indicated in the example above, and may be variable and/or user-settable.

Although the foregoing example of the invention has been described by reference to a single head cleaning system as illustrated in FIG. 1, it will be appreciated that multiple such cleaning devices may be used within a single vessel and can be controlled in keeping with the described principles. For example, it may be desirable to use two cleaning units such as that illustrated in FIG. 2 for speed of cleaning, or when a single spray head is unable to effectively reach certain areas of a vessel interior. Thus, it also anticipated that the described system will be used to control two or more spray heads within a single vessel in a coordinated fashion.

Although the foregoing examples have been described by reference to an air motor drive system to turn the cleaning device drive shaft, it will be appreciated that any other suitable drive system may be used instead. Other suitable drive systems include, without limitation, stepper motors, DC motors (e.g., brushless motors), AC motors (e.g., via variable frequency drive), hydraulic motors (e.g., driven by pressure transducer or control valve), and so on.

In addition, the spray head position and orientation may be reaction driven, e.g., by the reaction force of the spray ejected from the head. In this embodiment especially, but in other embodiments as well, a brake control rather than a drive control can be beneficial. The reactionary cleaning device may be more difficult to precisely drive than the shaft-driven units, but precision braking control may be provided via a disk or band brake, electrodynamic drag brake, or other controllable braking mechanism. In an aspect of the invention, controllable braking is combined with precision position sensing to yield accurate control of the spray head position and orientation.

With respect to the reactionary cleaning apparatus, the spray head may be fixed to rotate only in a single plane. Generally, one or more fluid outlets in the head will be shaped so as to fan the spray in a desired pattern as the device rotates. Thus, with respect to verifying that the tank is properly cleaned, the speed and rotation of the head are monitored in an embodiment of the invention.

With respect to a turbine-driven tank cleaning unit, the driving mechanism as well as the measurement mechanisms may be either internal or external to the tank. For example, an internal drive and internal rotation sensor as discussed elsewhere herein may be employed. In this example, the necessary pass-throughs include at least an electrical pass-through to extract the sensor output and a liquid feed through to supply fluid for rotation and cleaning.

Although the tank cleaning device as illustrated in FIG. 2 can be manipulated in two interrelated rotational dimensions, other dimensions of movement are provided in alternative aspects of the invention. For example, a linear degree of freedom is provided along the axis of shaft rotation in a further aspect of the invention. Such an arrangement is illustrated in FIG. 5.

It will be appreciated that the foregoing description relates to examples that illustrate a preferred configuration of the tank cleaning system. However, it is contemplated that other implementations of the invention may differ in detail from foregoing examples. As noted earlier, all references to the invention are intended to reference the particular example of the invention being discussed at that point and are not intended to imply any limitation as to the scope of the invention more generally. All language of distinction and disparagement with respect to certain features is intended to indicate a lack of preference for those features, but not to exclude such from the scope of the invention entirely unless otherwise indicated.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A system for monitoring a tank cleaning process, the system comprising:

a tank cleaning device having a single shaft linked to a spray head mechanism via a gearing mechanism, said single shaft being driven by an actuator that causes rotation of the single shaft about a drive axis, wherein rotation of the single shaft causes rotation of the spray head mechanism about the drive axis and a second axis disposed perpendicular to the drive axis such that at least one orifice of the spray head mechanism follows a helical path having a circular shape that rotates about the drive axis and that is predetermined based on parameters of the gearing mechanism to provide non-overlapping, equally spaced latitudinal traverses of a spray jet into the interior of the tank;

a rotational detector affixed to the single shaft to provide a position signal associated with the single shaft that is translatable to a position of the spray head mechanism about each axis of rotation thereof through multiple complete rotations of the single shaft, wherein the position signal indicates the specific degree of rotation of the single shaft from a starting orientation;

a controller programmed and configured to control the rotation of the shaft, and thus the spray head, to adjust, at a given location along the predetermined path, at least one of a stream dwell time and a pressure of the cleaning fluid, and to monitor a tank cleaning cycle by executing the following process:

receive a set of cleaning instructions defining cleaning parameters related to the movement of the spray head;

store therein a translation table that correlates the position signal to a particular position and orientation data of the spray head mechanism, determine a starting position and orientation of the spray head within the tank based on the translation table and the starting orientation provided by the rotational detector;

determine an actual position of the spray head mechanism in the tank based on the starting position and orientation, the position signal, the parameters of the gearing mechanism and the translation table as primary control parameters;

based on the determined position and orientation of the spray head mechanism within the tank, calculate spray impact locations and sweep trajectory of the spray jet emanating from the spray head mechanism, selectively control a rotational speed and a direction of rotation of the single shaft by providing appropriate command signals to the actuator, thus controlling the position, velocity and orientation of the spray head mechanism based on the position signal and the translation table, alter a flow rate of the cleaning fluid as a function of position and orientation of the spray head mechanism within the tank as determined based on the position signal and the translation table, stop the flow rate of the cleaning fluid for certain orientations of the spray head mechanism including orientations when the spray jet may exit an open portion of the tank;

initiate a tank cleaning cycle in accordance with the received set of cleaning instructions, and as the tank cleaning cycle proceeds, calculate the position, rotation, angle, and speed of the head;

compare the calculated position, rotation, angle, and speed of the head to expected values for such parameters, the expected values being derived from control signals provided to the head based on the received set of cleaning instructions;

signal a failed tank cleaning cycle if the calculated values do not substantially match the expected values; and if the calculated values do substantially match the expected values, check a fluid source pressure;

compare the fluid source pressure to an expected fluid source pressure and, if the fluid source pressure is substantially different than the expected fluid source pressure, execute a task including at least one of: signaling a failed tank cleaning cycle and recording an error.

2. The system for monitoring a tank cleaning process according to claim 1, wherein the position signal associated with the position of the spray head comprises an angle signal indicating an angle of rotation of the end member and a rotation count signal indicating a number of rotations undergone by the end member.

3. The system for monitoring a tank cleaning process according to claim 1, wherein the controller is implemented as a program running on a computing device.

4. The system for monitoring a tank cleaning process according to claim 1, wherein the controller is implemented as a programmable logic circuit.

5. The system for monitoring a tank cleaning process according to claim 1, wherein the controller is further adapted to provide a verification signal when the tank cleaning cycle has been successfully completed.

6. The system for monitoring a tank cleaning process according to claim 1, wherein the spray head comprises two nozzles.

7. The system for monitoring a tank cleaning process according to claim 1, wherein the controller is adapted to control the operation of the fluid source to modify the pressure of the fluid.

8. The system for monitoring a tank cleaning process according to claim 1, wherein the controller increases the pressure of the cleaning fluid when the at least one nozzle directs fluid at a predetermined location of the tank interior.

9. The system for monitoring a tank cleaning process according to claim 1, wherein the controller slows the rotation of the end member when the at least one nozzle directs fluid at a predetermined location of the tank interior.

10. The system for monitoring a tank cleaning process according to claim 1, wherein the controller stops the rotation of the end member when the at least one nozzle directs cleaning fluid at a predetermined location of the tank interior.

* * * * *